US010716191B1

(12) United States Patent
Zhong et al.

(10) Patent No.: US 10,716,191 B1
(45) Date of Patent: Jul. 14, 2020

(54) DIMMER SYSTEM AND METHOD OF POWERING REMOTE DIMMERS

(71) Applicant: EATON INTELLIGENT POWER LIMITED, Dublin (IE)

(72) Inventors: Kevin Zhong, Shanghai (CN); Saivaraprasad Murahari, Peachtree City, GA (US); Lily Du, Shanghai (CN); Martin Chen, Shanghai (CN); Ahmed El-Gayyar, Senoia, GA (US); Lin Yang, Shanghai (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/725,077

(22) Filed: Dec. 23, 2019

(51) Int. Cl.
*H05B 47/10* (2020.01)
*H05B 47/175* (2020.01)

(52) U.S. Cl.
CPC ..... *H05B 47/175* (2020.01)

(58) Field of Classification Search
CPC ..... H05B 45/00; H05B 45/10; H05B 45/20; H05B 47/00; H05B 47/10; H05B 47/175
See application file for complete search history.

(56) References Cited

U.S. PATENT DOCUMENTS

2019/0098734 A1* 3/2019 Dolan ..... H05B 45/00
2019/0166678 A1* 5/2019 Raneri ..... H05B 47/185

* cited by examiner

*Primary Examiner* — Jimmy T Vu
(74) *Attorney, Agent, or Firm* — Eckert Seamans Cherin & Mellott, LLC

(57) ABSTRACT

A dimmer system includes a master dimmer electrically connected between a power source and a load and structured to control dimming of the load. The master dimmer includes a power supply structured to generate first direct current power and second direct current power and a constant current circuit structured to fix a current level of the second direct current power. The dimmer system also includes a plurality of remote dimmers structured to receive and be powered by the second direct current power with the fixed current level.

20 Claims, 3 Drawing Sheets

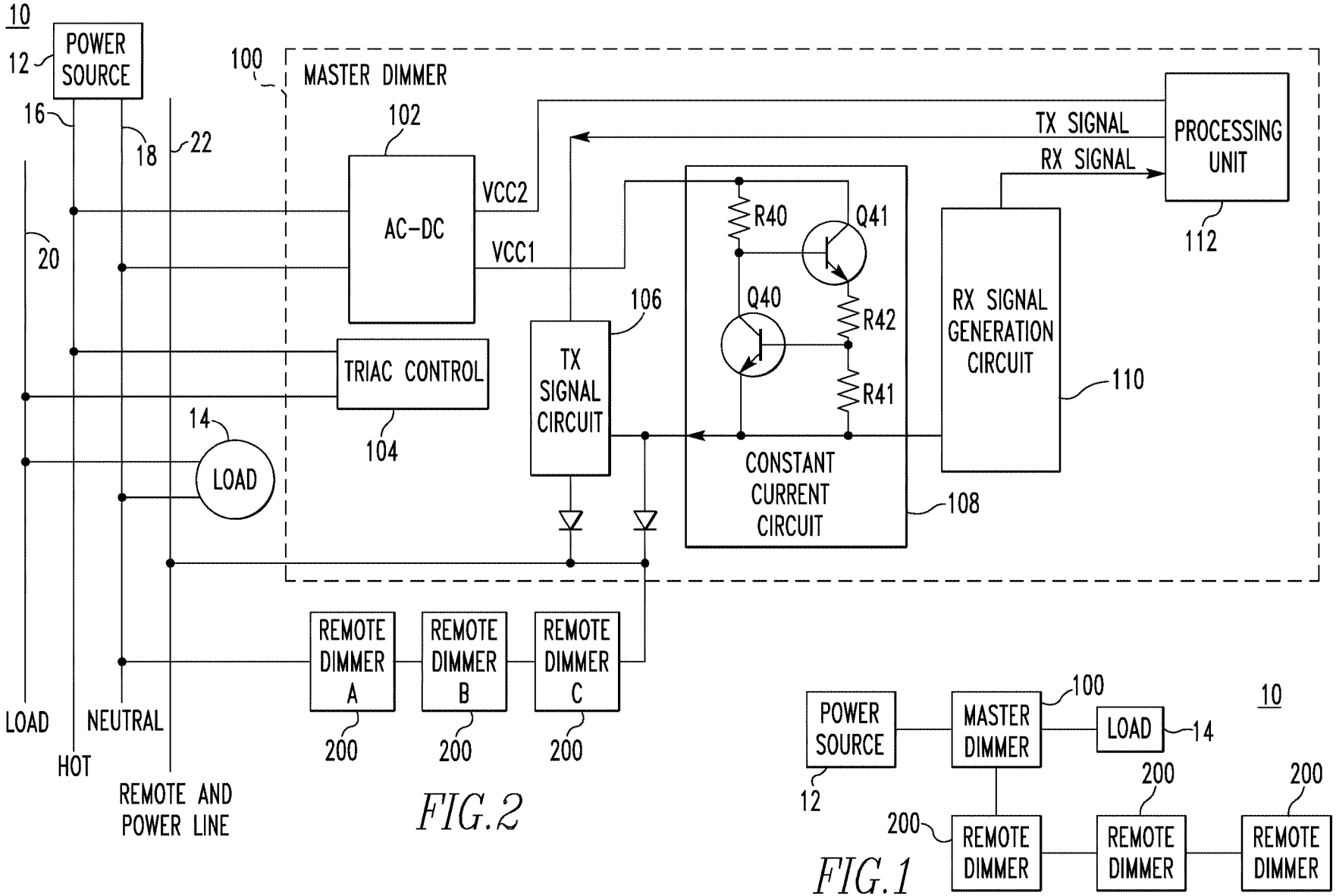
10
POWER SOURCE
12
MASTER DIMMER
100
MASTER DIMMER
LOAD
14
REMOTE DIMMER
200
REMOTE DIMMER
REMOTE DIMMER
REMOTE DIMMER

DIMMER SYSTEM AND METHOD OF POWERING REMOTE DIMMERS

BACKGROUND OF THE INVENTION

Field of the Invention

The disclosed concept relates generally to dimmers for use with a load, and in particular, to a dimmer system including a master dimmer and one or more remote dimmers. The disclosed concept also relates to methods of powering remote dimmers.

Background Information

Dimmers provide a dimming function for loads such as lights. Dimmers are generally placed between a power source and the load and control the nature of the power provided to the load. Very simple dimmers regulate the voltage provided to the load by, for example, dividing the voltage using a variable resistor. However, dimming in this manner is inefficient as remaining power not provided to the load is dissipated as heat.

More recent dimmers cut off a part of each half-cycle of the power provided to the load. In some dimmers, the cut off is from a zero crossing in the power until a predetermined time after the zero crossing. Increasing the predetermined amount of time increase the amount of dimming. Cutting off a part of the waveform can be accomplished using a circuit component such as a triac. The more recent dimmers provide increased power efficiency over prior dimmers that used a variable resistor.

The power efficiency of a dimmer is a significant concern. California Title 20 specifies that dimmers cannot consume more than 1 W per dimmer leg when in the off position.

Many modern dimmers incorporate a processor for control of dimming functions. Some dimmer systems include a master dimmer and remote dimmers. The remote dimmers include buttons or switches for controlling the load and relay control signals back to the master dimmer. The master dimmer ultimately includes the circuitry, such as a triac, necessary for controlling dimming of the load. In this type of dimmer system, a user can interact with buttons or switches on the master dimmer or any of the remote dimmers to control dimming of the load. The remote dimmers include their own processor and are powered via the master dimmer. As a result of powering the remote dimmers, the prior master dimmer consumes more than 1 W of power per dimmer leg even when in the off position.

There is room for improvement in dimmer systems. There is also room for improvement in methods of powering remote dimmers.

SUMMARY OF THE INVENTION

These needs, and others, are met by at least one embodiment of the disclosed concept in which a master dimmer provides direct current power having a fixed current to multiple remote dimmers.

In accordance with an example embodiment of the disclosed concept, a dimmer system comprises: a master dimmer electrically connected between a power source and a load and structured to control dimming of the load, the master dimmer including: a power supply structured to generate first direct current power and second direct current power, and a constant current circuit structured to fix a current level of the second direct current power; and a plurality of remote dimmers structured to receive and be powered by the second direct current power with the fixed current level.

In accordance with an example embodiment of the disclosed concept, a method of powering a plurality of remote dimmers with a master dimmer comprises: generating first direct current power with the master dimmer; powering the master dimmer with the first direct current power; generating second direct current power with the master dimmer; fixing a current level of the second direct current power; and providing the second direct current power with the fixed current level to the plurality of remote dimmers.

In accordance with an example embodiment of the disclosed concept, a master dimmer structured to be electrically connected between a power source and a load comprises: a triac control circuit structured to selectively provide power from the power source to the load; a processing unit structured to control the triac control circuit to adjust a dimming level of the load; a power supply structured to convert alternating current from the power source to first direct current power and second direct current power, and a constant current circuit structured to fix a current level of the second direct current power and to provide the second direct current power with the fixed current level to a conductor electrically connected to a plurality of remote dimmers.

BRIEF DESCRIPTION OF THE DRAWINGS

A full understanding of the invention can be gained from the following description of the preferred embodiments when read in conjunction with the accompanying drawings in which:

FIG. 1 is a schematic diagram of a dimmer system in accordance with an example embodiment of the disclosed concept;

FIG. 2 is a schematic diagram of a dimmer system showing a master dimmer in more detail in accordance with an example embodiment of the disclosed concept;

DESCRIPTION OF THE PREFERRED EMBODIMENTS

Figure 3:
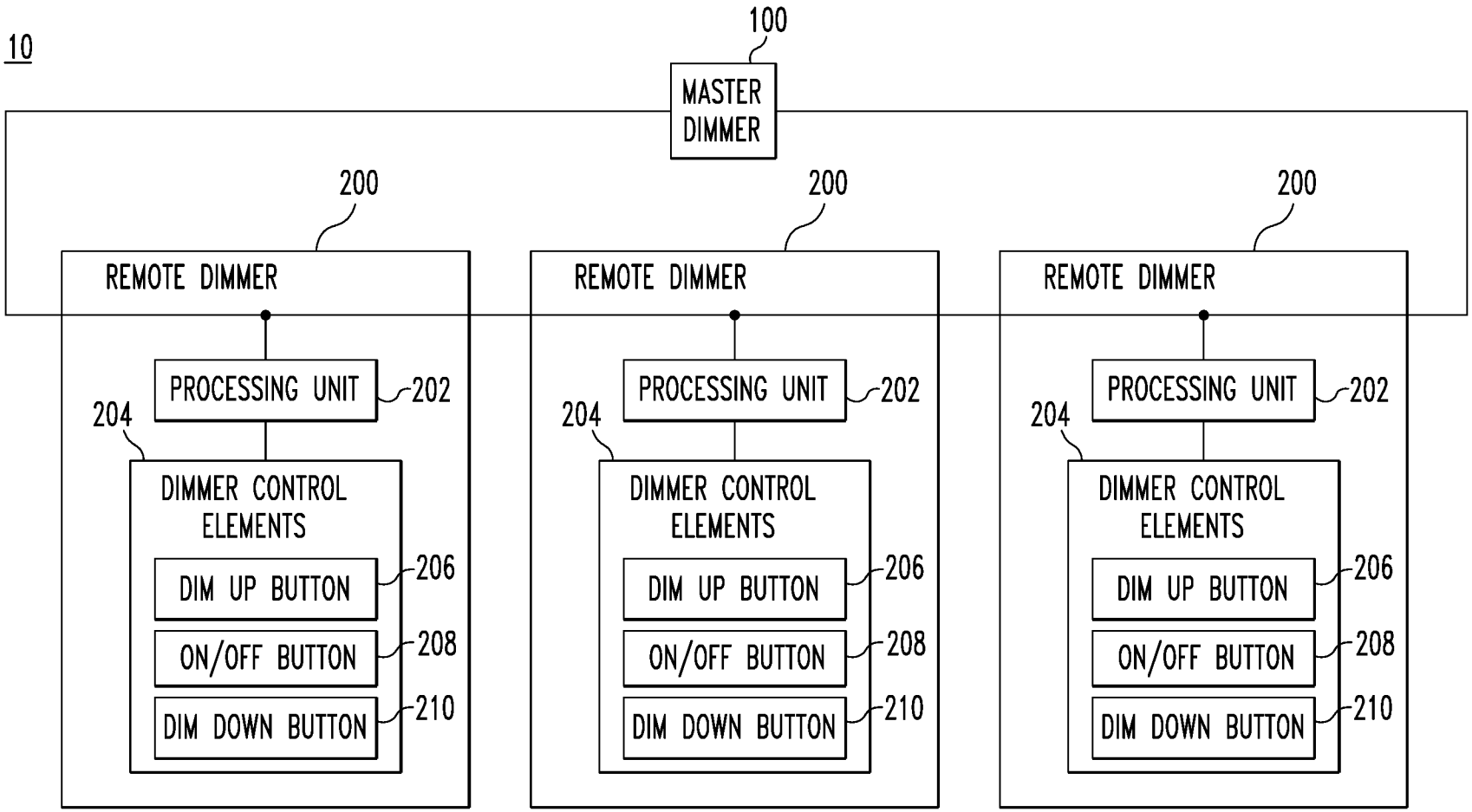
FIG. 3 is a schematic diagram of a dimmer system showing remote dimmers in more detail in accordance with an example embodiment of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the term "number" shall mean one or an integer greater than one (i.e., a plurality).

FIG. 1 is a schematic diagram of a dimmer system 10 in accordance with an example embodiment of the disclosed concept. The dimmer system 10 includes a master dimmer 100 and a number of remote dimmers 200. The master dimmer 100 is electrically connected between a power source 12 and a load 14. The power source 12 may, in some example embodiments, be utility power. The load 14 may, in some example embodiments, be a dimmable type of load such as one or more dimmable lights.

The master dimmer 100 is structured to control dimming of the load 14. In some example embodiments, the master dimmer 100 is structured to regulate power provided from the power source 12 to the load 14 in order to facilitate dimming of the load 14. For example and without limitation, the master dimmer 100 may implement a forward or reverse phase cut in the power provided to the load 14 in order to facilitate dimming of the load. The master dimmer 100 may include a semiconductor switch, such as a triac, electrically connected between the power source 12 and the load 14 in order to regulate power provide to the load 14 and implement dimming of the load 14.

The master dimmer 100 is also structured to provide power to operate the remote dimmers 200. For example, the master dimmer 100 is structured to convert alternating current (AC) from the power source 12 to direct current (DC) power. In some example embodiments, the master dimmer 100 is structured to convert AC power from the power source 12 to first DC power and second DC power. The master dimmer 100 is structured to use the first DC power to operate itself. The second DC power is divided among the remote dimmers 200 to power the remote dimmers 200. For example, the master dimmer 200 may include a constant current circuit. The second DC power has a fixed voltage and is fed into the constant current circuit and provided to the remote dimmers 200 via the constant current circuit. The result is that the second DC power is divided among the remote dimmers 200. Moreover, by fixing the voltage of the second DC power, and fixing the current of the second DC power via the constant current circuit, the total amount of power provided to the remote dimmers 200 is limited. In some example embodiments, the total amount of power provided to the remote dimmers 200 is less than 1 W, regardless of the number of remote dimmers 200 powered by the master dimmer 100. In some example embodiments, up to three remote dimmers 200 are powered by the master dimmer 100. However, it will be appreciated that other numbers of the remote dimmers 200 may be powered by the master dimmer 100 without departing from the scope of the disclosed concept.

The master dimmer 100 and the remote dimmers 200 are structured to communicate with each other. In some example embodiments, the master dimmer 100 is structured to control dimming of the load 14. The remote dimmers 200 are structured to receive user inputs to control dimming of the load 14 (e.g., dim up, dim down, on, off). The remote dimmers 200 are structured to communicate corresponding commands to the master dimmer 100, and, in response, the master dimmer 100 is structured to control dimming of the load 14 based on these commands. For example, in response to a dim up command received from a remote dimmer 200, the master dimmer 100 is structured to correspondingly adjust dimming of the load 14. The master dimmer 100 may also receive user inputs to control dimming of the load 14, in which case the master dimmer 100 correspondingly adjusts dimming of the load based on the user inputs. In some example embodiments of the disclosed concept, the master dimmer 100 and remote dimmers 200 may communicate status information, such as a status update of the dimming level of the load 14, such that any indicators on the master and/or remote dimmers 100,200 may be updated.

FIG. 2 is a schematic diagram of the dimmer system 10 and shows an example embodiment of the master dimmer 100 in more detail. In accordance with the example embodiment shown in FIG. 2, the master dimmer 102 is electrically connected to the power source 12 via hot and neutral conductors 16,18. The master dimmer 100 is electrically connected to the load via load and neutral conductors 20,18. The master dimmer 100 is also electrically connected to the remote dimmers 200 via a remote conductor 22.

The master dimmer 100 includes a power supply 102 and a constant current circuit 108. The power supply 102 is structured to receive AC power from the power source 12 via the hot and neutral conductors 16,18. The power supply 102 is structured to convert the AC power into first DC power VCC1 and second DC power VCC2, each having fixed DC voltages. The power supply 102 is structured to provide the first DC power VCC1 to a processing unit 112 included in the master dimmer 100 in order to provide power to operate the master dimmer 100. The power supply 102 is structured to provide the second DC power VCC2 to the constant current circuit 108.

The constant current circuit 108 is structured to fix the current of the second DC power VCC2 and to provide the second DC power VCC2 with a fixed voltage and current to the remote dimmers 200. The constant current circuit 108 may be any type of circuit that provides a fixed constant current. FIG. 2 illustrates one example embodiment of a circuit that provides a fixed constant current. In the example embodiment of FIG. 2, the constant current circuit 108 includes first, second, and third resistors R40,R41, R42, and first and second switches Q40,Q41. However, it will be appreciated that other types of circuits that provide a constant fixed current may be provided without departing from the scope of the disclosed concept. The output of the constant current circuit 108 is electrically coupled to the remote dimmers 200 such that the second DC power VCC2 is provided to the remote dimmers 200, resulting in the second DC power VCC2 being divided among the remote dimmers 200.

The master dimmer 100 includes a triac control circuit 104 electrically connected to the hot and load conductors 16,20. The triac control circuit 104 is operable to selectively provide power from the hot conductor 16 to the load conductor 20 in order to regulate power provided to the load 14 via the load conductor 20 and facilitate dimming of the load 14. The triac control circuit 104 may include a switch, such as triac, which is selectively opened and closed to selectively provide power from the hot conductor 16 to the load conductor 20. The processing unit 112 is structured to control the triac control circuit 104 in order to control dimming of the load 14. For example, the processing unit 112 may control the triac control circuit 104 to selectively open and close the triac to provide forward or reverse-phase cutting of power provided to the load 14 in order to control the level of dimming of the load 14.

The master dimmer 100 also includes a transmission signal generation circuit 106 and a received signal generation circuit 110. The transmission signal generation circuit 106 is structured to receive commands from the processing unit 112 and to correspondingly generate transmission signals that are transmitted to the remote dimmers 200 to communicate with the remote dimmers 200. The received signal generation circuit 110 is structured to receive signals from the remote dimmers 200 (e.g., command signal such as dim up, dim down, on, off) from the remote dimmers 200 and to translate these signals and provide corresponding commands to the processing unit 112. In this manner, the processing unit 112 is able to transmit signals to the remote dimmers 200 via the transmission signal generation circuit 106 and to receive signals from the remote dimmers 200 via the received signal generation circuit 110. The signals transmitted to the remote dimmers 200 may be, for example, updates regarding the status or dimming level of the load 14 or other information. The signals transmitted from the remote dimmers 200 to the master dimmer 100 may be commands to adjust the dimming level or on/off status of the load 14.

In some example embodiments, the master dimmer 100 is structured to provide the second DC power VCC2 and to communicate with the remote dimmers 200 via the remote conductor 22. However, it will be appreciated that the master dimmer 100 and the remote dimmers 200 may communicate via different mechanisms without departing from the scope of the disclosed concept. For example, and without limitation, the master dimmer 100 and the remote dimmers 200 may communicate via wireless communication rather than wired communication without departing from the scope of the disclosed concept.

FIG. 3 is a schematic diagram of a dimmer system 10 in accordance with an example embodiment of the disclosed concept and shows the remote dimmers 200 in more detail. The remote dimmers 200 each include a processing unit 202 and dimmer control elements 204. The processing unit 202 is electrically connected to the master dimmer 100 via a conductor. For example, the processing unit 202 is electrically connected to the constant current circuit 108 (shown in FIG. 2) of the master dimmer 100. The processing unit 202 is structured to receive power from the master dimmer 100 via the conductor. The power received from the master dimmer 100 is used to power the processing unit 202 and any other components of the remote dimmer 200 requiring power to operate. The processing unit 202 is also structured to control operations of the remote dimmer 200 and to generate control signals to communicate with the master dimmer 100.

The remote dimmer 200 also includes dimmer control elements 204 which a user may interact with to control dimming of the load 14. In an example embodiment, the dimmer control elements 204 include a dim up button 206, an on/off button 208, and a dim down button 210. For example, a user may interact with the dim up button 206 by pressing it to effectuate dimming up of the load 14. In response to pressing the dim up button 206, the processing unit 202 generates a control signal including a dim up command and transmits the control signal to the master dimmer 100. The control signal is received by the received signal generation circuit 110 (shown in FIG. 2), which translates the command and provides it to processing unit 112 of the master dimmer 100. In response, the processing unit 112 controls the triac control circuit 106 to raise the dimming level of the load 14. In a similar manner, the processing unit 202 generates commands corresponding to a user interacting with the on/off button 208 and the dim down button 210 and transmits these commands to the master dimmer 100 where the master dimmer 100 then correspondingly adjusts the dimming level or on/off status of the load 14 based on such commands.

While example of dimmer control elements 204 are buttons, it will be appreciated that other type of control elements a user may interact with may be employed without departing from the scope of the disclosed concept. Non-limiting examples of such control elements include sliders, knobs, switches, etc.

Figure 4:
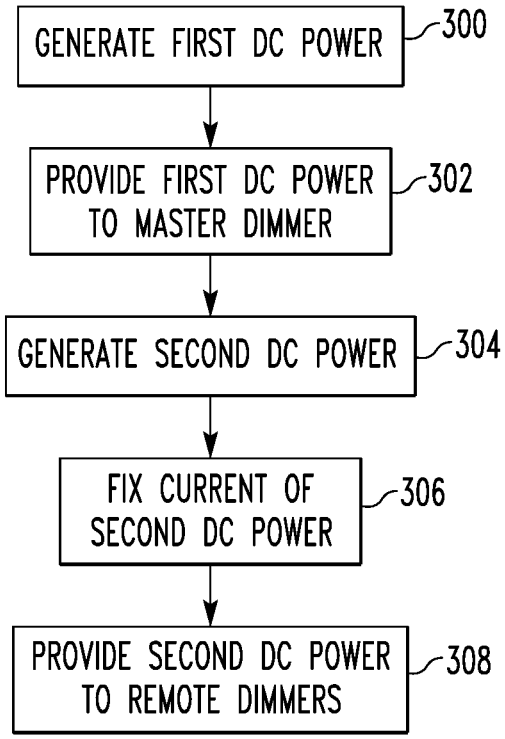
FIG. 4 is a flowchart of a method of powering remote dimmers in accordance with an example embodiment of the disclosed concept.

FIG. 4 is a flowchart of a method of powering a dimmer system in accordance with an example embodiment of the disclosed concept. The method may be implemented, for example, in the dimmer system 10 of FIGS. 1-3. However, it will be appreciated that the method may be implemented in other dimmer systems without departing from the scope of the disclosed concept.

The method begins at 300 with generating first DC power. The first DC power may be generated by the power supply 102 and may be VCC2. The method proceeds to 302 where the first DC power is provided to the master dimmer 100. In some example embodiments, the first DC power may be provided to the processing unit 112 and other components of the master dimmer 100 that require DC power to operate.

At 304, second DC power is generated. The second DC power may be generated by the power supply 102 and may be VCC1. It will be appreciated that the first and second DC power may have fixed voltages (i.e., voltages that remain constant). At 306, the current of the second DC power is fixed. The current of the second DC power may be fixed by the constant current circuit 108. However, it will be appreciated that other types of circuits or components may be used to fix the current of the second DC power without departing from the scope of the disclosed concept. At 308, the second DC power, with a fixed voltage and current, is provided to the remote dimmers 308. The second DC power, with the fixed voltage and current, is used to power the remote dimmers 200. As the second DC power has a fixed voltage and current, the second DC power will be divided among the remote dimmers 200 and the remote dimmers 200 will be unable to draw additional power. In this manner, the power provided to the remote dimmers 200 from the master dimmer 100 is limited. In some example embodiments, the total power provided from the master dimmer 100 to the remote dimmers 200 is less than 1 W, and thus compliant with California Title 20.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A dimmer system comprising:

a master dimmer electrically connected between a power source and a load and structured to control dimming of the load, the master dimmer including:

a power supply structured to generate first direct current power and second direct current power, and a constant current circuit structured to fix a current level of the second direct current power; and a plurality of remote dimmers structured to receive and be powered by the second direct current power with the fixed current level.

2. The dimmer system of claim 1, wherein a total power of the second direct current power is less than 1 W.

3. The dimmer system of claim 1, wherein the master dimmer includes:

a first processing unit structured to receive and be powered by the first direct current power.

4. The dimmer system of claim 3, wherein the plurality of remote dimmers each include:

a second processing unit structured to receive and be powered by the second direct current power with the fixed current level.

5. The dimmer system of claim 3, wherein the master dimmer includes:

a triac control circuit structured to selectively provide power to the load, wherein the first processing unit is structured to control the trial control circuit to adjust a dimming level of the load.

6. The dimmer system of claim 1, wherein at least one of the plurality of remote dimmers includes one or more dimmer control elements, wherein the one or more dimmer control elements are structured such that a user can interact with them.

7. The dimmer system of claim 6, wherein the at least one of the plurality of remote dimmers is structured to transmit a control signal to the master dimmer in response to the user interacting with the one or more dimmer control elements, and wherein the master dimmer is structured to adjust a dimming level of the load in response to the control signal.

8. The dimmer system of claim 1, wherein the power supply is structured to fix a voltage level of the second direct current power.

9. The dimmer system of claim 1, wherein the second direct current power with the fixed current is divided evenly among the plurality of remote dimmers.

10. The dimmer system of claim 1, further comprising:

a conductor electrically connected to the master dimmer and the plurality of remote dimmers, wherein the plurality of remote dimmers are structured to receive the second direct current power with the fixed current via the conductor, wherein the master dimmer is structured to generate and transmit a first signal to the plurality of remote dimmers via the conductor; and wherein the plurality of remote dimmers are structured to generate and transmit a second signal to the master dimmer via the conductor.

11. The dimmer system of claim 10, wherein the first signal indicates a dimming level of the load to the plurality of remote dimmers, wherein the second signal indicates one or more dimming control commands to the master dimmer, and wherein the master dimmer is structured to control dimming of the load based on the one or more dimming control commands.

12. The dimmer system of claim 1, wherein he constant current circuit includes first, second, and third resistors and first and second switches.

13. A method of powering a plurality of remote dimmers with a master dimmer, the method comprising:

generating first direct current power with the master dimmer;

powering the master dimmer with the first direct current power;

generating second direct current power with the master dimmer;

fixing a current level of the second direct current power; and providing the second direct current power with the fixed current level to the plurality of remote dimmers.

14. The method of claim 13, wherein a total power of the second direct current power is less than 1 W.

15. The method of claim 13, further comprising:

transmitting a control signal from one of the plurality of remote dimmers to the master dimmer; and adjusting a dimming level of a load with the master dimmer based on the control signal.

16. The method of claim 13, wherein the second direct current power with the fixed current is divided evenly among the plurality of remote dimmers.

17. The method of claim 13, further comprising:

transmitting a first signal from the master dimmer to the plurality of remote dimmers; and transmitting a second signal from one of the plurality of remote dimmers to the master dimmer.

18. A master dimmer structured to be electrically connected between a power source and a load, the master dimmer comprising:

a triac control circuit structured to selectively provide power from the power source to the load;

a processing unit structured to control the triac control circuit to adjust a dimming level of the load;

a power supply structured to convert alternating current from the power source to first direct current power and second direct current power, and a constant current circuit structured to fix a current level of the second direct current power and to provide the second direct current power with the fixed current level to a conductor electrically connected to a plurality of remote dimmers.

19. The master dimmer system of claim 18, wherein a total power of the second direct current power is less than 1 W.

20. The dimmer of claim 18, further comprising:

a first processing unit structured to receive and be powered by the first direct current power.

* * * * *